United States Patent [19]

Schachter

[11] 4,079,936

[45] Mar. 21, 1978

[54] FOAM BAT

[76] Inventor: Robert S. Schachter, 1166 Beacon St., Brookline, Mass. 02146

[21] Appl. No.: 743,784

[22] Filed: Nov. 22, 1976

[51] Int. Cl.[2] ..... A63B 59/00

[52] U.S. Cl. ..... 273/67 R

[58] Field of Search ..... 273/26 B, 29 A, 67 R, 273/67 B, 72 R, 55 R, 55 A, 95 R, 95 A, 96 R, 1 R, DIG. 8, 106; 272/76, 1 B, 1 D, 77, 68; 5/337, 338, 341, 342, 361 R, 361 B; 46/86, 87, 90, 156–159; 119/29; 9/310 F, 310 J, 329, 336, 347, 348

[56] References Cited

U.S. PATENT DOCUMENTS

| | | | |
|---|---|---|---|
| 1,916,811 | 7/1933 | Schwartz | 46/158 |
| 2,987,317 | 6/1961 | Acevedo | 273/67 R |
| 3,094,722 | 6/1963 | Lerner | 9/348 X |
| 3,141,261 | 7/1964 | Mirando | 46/90 X |
| 3,185,476 | 5/1965 | Fechner | 273/DIG. 8 |
| 3,336,029 | 8/1967 | London | 273/67 R |
| 3,384,372 | 5/1968 | Dickens | 273/55 A |
| 3,528,116 | 9/1970 | Fenar | 273/1 B X |
| 3,606,322 | 9/1971 | Kersch | 273/67 R X |
| 3,849,810 | 11/1974 | Degen | 5/341 |
| 3,921,978 | 11/1975 | Warren | 273/67 R |
| 3,958,801 | 5/1976 | Correa | 273/55 R X |

FOREIGN PATENT DOCUMENTS

| | | | |
|---|---|---|---|
| 294,079 | 3/1932 | Italy | 9/329 |

OTHER PUBLICATIONS

"My Weekly Reader," vol. 49, Issue 16, Jan. 27, 1971, p. 6.

*Primary Examiner*—Richard J. Apley
*Attorney, Agent, or Firm*—Wolf, Greenfield & Sacks

[57] ABSTRACT

A resilient, flexible foam plastic or rubber bat is used as an amusement device or child's psychological play aid or the like. The bat is entirely free of internal rigidifying members. A band of material tightly wrapped about the bat adjacent an end to form a narrowed region in which the foam material is compressed to provide a handle sufficient with rigidity and tear strength and without requiring the use of internal rigid members.

8 Claims, 5 Drawing Figures

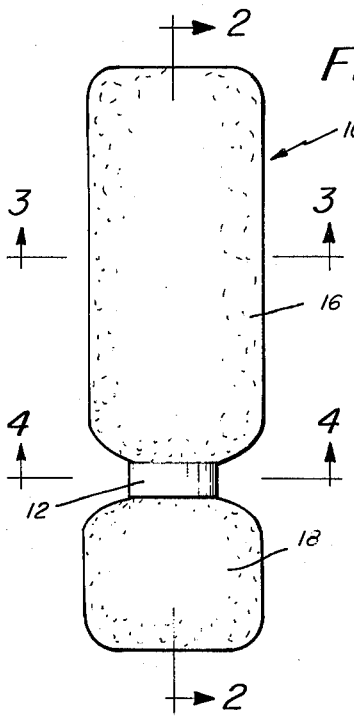
Fig. 1
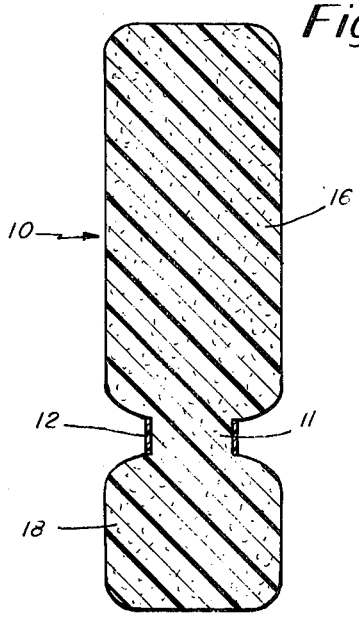
Fig. 2
Fig. 3
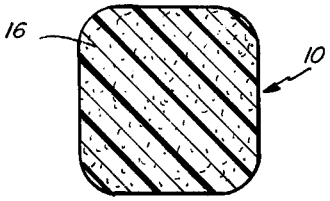
Fig. 4
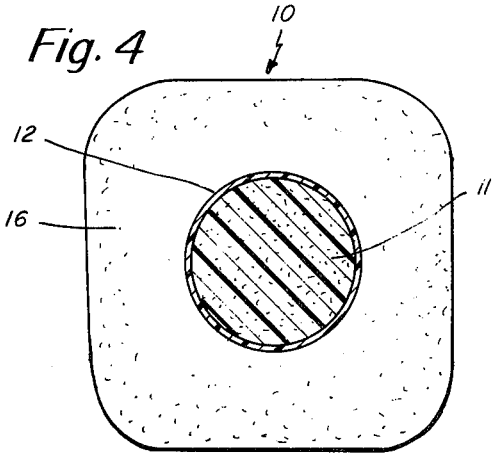
Fig. 5
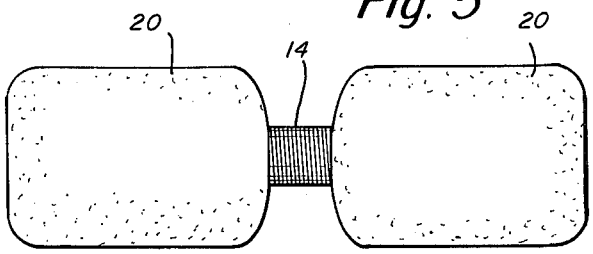

FOAM BAT

BACKGROUND AND SUMMARY OF THE INVENTION

This invention relates to an amusement device which can be used by adults or children. For example, the device may be used by a child in an aggressive manner as might be desirable as an aid in psychological play therapy where it may be desirable to induce the child to act out hostile or aggressive feelings. Although such toys have been proposed and are now employed both in psychological counseling as well as in ordinary play, they do present some difficulties, particularly in regard to their safety. Perhaps the primary difficulty resides in the fact that prior bats have all utilized some form of central or internal rigid core such as a tube or a rod to provide sufficient strength for the foam material so that it may have reasonable durability and will not break or tear after a short period of use. Often, the rigid core in the prior devices is used as a handle by which the device may be gripped. The presence of the rigid core renders the device unsafe and there have been instances in which a child has been struck by the bat in such a manner that the core injured the child, sometimes seriously.

It is among the general objects of the invention to provide a toy of the type described which avoids these and other difficulties. In brief, my invention consists of an elongate bat made from a single, unitary length of resilient, flexible foam plastic or rubber which is totally free of any rigid supplementary supporting or stiffening elements, the bat being made in its entirety from the foam material. A handle is defined between the ends of the bat by wrapping a band of material about the bat to define a narrowed region of compressed foam material. The handle region defines and separates the main and end portions of the bat. The compressed foam material at the handle portion provides sufficient strength to resist tearing and other damage which would ordinarily be expected to occur with such a device.

It is among the general objects to provide an improved child's bat which may be used as a toy both in regular play and as a therapeutic aid in psychological counseling.

Another object of the invention is to provide a bat or device of the type described which is totally free of internal rigidifying members.

A further object of the invention is to provide a bat of the type described which provides a high degree of safety in use.

Another object of the invention is to provide a bat of the type described which is of simple and inexpensive construction yet which is durable.

Still another object of the invention is to provide a bat of the type described in which the handle portion of the bat is defined by a region of compressed foam.

DESCRIPTION OF THE DRAWINGS

The foregoing and other objects and advantages of the invention will be appreciated more fully from the following further description thereof, with reference to the accompanying drawings wherein:

FIG. 1 is a side elevation of the bat;

FIG. 2 is a longitudinal section of the bat as seen along the line 2—2 of FIG. 1;

FIG. 3 is a section of the bat as seen along the line 3—3 of FIG. 1;

FIG. 4 is a sectional illustration of the handle portion as seen along the line 4—4 of FIG. 2; and FIG. 5 is an illustration of another embodiment of the invention.

DESCRIPTION OF THE PREFERRED EMBODIMENT

As shown in the drawings, the bat is formed from a single elongate piece 10 of foam plastic or rubber. The foam plastic or rubber is semi-rigid and resilient. By way of example, high density polyurethane foam of a density between approximately 1.7 to 3.7 pounds per cubic foot may be used. The foam material should be flexible to the touch. The bat is approximately eighteen inches long and preferably about 4.5 inches across in cross section. The length of foam material may be molded or may be cut from a strip of the material.

In the embodiment shown in FIGS. 1–4, a round handle portion 11 is formed intermediate the ends of the bat in proximity to one of the ends. The handle is formed by a collar 12 which is wrapped tightly about that region which is to form the handle. The collar may be formed from a strip of plastic or, alternatively, may simply comprise yarn 14 (suggested in FIG. 5) wrapped about the handle region. The plastic or yarn collar compresses the region of the foam material which it surrounds to a more dense configuration as shown in FIG. 4. The foam in the handle region 11 preferably is compressed to increase the density of the foam between three and five times that of the uncompressed foam. This construction has been found to provide rigidity and tear strength at least equal to the prior devices which have employed separate rigid stiffeners. The collar thus defines a main bat portion 16 at one end and, at the opposite end, a resilient foam minor portion 18 which serves to protect the hand of the child holding the bat as well as the child or object being struck. In a device dimensioned as suggested above, the handle portion 11 is of the order of two or two and one half inches in diameter, approximately half that of the cross sectional dimension of the main or minor portions of the bat. The main portion of the bat preferably is of substantially uniform cross section along its length.

It may be noted that there may be instances in which it would be desirable to locate the collar and handle at the midportion of the device, as suggested in FIG. 5, thus defining two main portions indicated at 20 on opposite sides of the collar.

From the foregoing it should be appreciated that the present invention provides a safe yet sufficiently strong and effective bat-type of device or toy. The total absence of an internal rigidying member enhances safety of the device as well as resulting in relatively inexpensive and simple manufacture. It may be used in a variety of environments, by adults and children alike.

It should be understood, however, that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. An injury-free foam bat comprising:

an elongate member formed from resilient, semi-rigid foam material;

a collar extending tightly about the member at a location intermediate its ends to define a narrowed handle portion, the foam material within the collar being compressed so as to be more rigid than the uncompressed portions thereof;

said collar defining and separating the member into a main portion and a secondary portion on opposite sides of the collar;

said bat being formed substantially in its entirety from said resilient semi-rigid foam material and being free from any supplemental internal rigidifying members.

2. A bat as defined in claim 1 wherein the collar comprises a continuous ring of plastic.

3. A bat as defined in claim 1 wherein the collar comprises yarn wrapped about the handle portion.

4. A bat as defined in claim 1 wherein the foam in the handle portion is compressed to a density of between three and five times that of the uncompressed foam material.

5. A bat as defined in claim 1 wherein said semirigid foam material further comprising polyurethane flexible to the touch and having a density of between approximately 1.7to 3.7 pounds per cubic foot.

6. A bat as defined in claim 1 wherein the collar is disposed at the midportion of the elongate member, the main and secondary portions being of substantially the same size.

7. A bat as defined in claim 1 wherein said handle portion is compressed to an extent that its cross-sectional dimensions are of the order of one-half that of the corresponding cross-sectional dimensions of the elongate member.

8. A bat as defined in claim 7 wherein said main portion and said secondary portion are of substantially the same cross-sectional configuration and are of substantially uniform size along the full length of the elongate member.

* * * * *